US010383374B2

(12) United States Patent
Miller

(10) Patent No.: US 10,383,374 B2
(45) Date of Patent: Aug. 20, 2019

(54) MOSQUITO AND SAFETY GARMENT

(71) Applicant: Rebecca Miller, Hendersonville, NC (US)

(72) Inventor: Rebecca Miller, Hendersonville, NC (US)

( * ) Notice: Subject to any disclaimer, the term of this patent is extended or adjusted under 35 U.S.C. 154(b) by 174 days.

(21) Appl. No.: 15/647,617

(22) Filed: Jul. 12, 2017

(65) Prior Publication Data

US 2017/0311654 A1 Nov. 2, 2017

Related U.S. Application Data

(63) Continuation-in-part of application No. 14/804,848, filed on Jul. 21, 2015, now abandoned.

(60) Provisional application No. 62/027,461, filed on Jul. 22, 2014.

(51) Int. Cl.

| | |
|---|---|
| ***A41D 13/00*** | (2006.01) |
| ***A41D 13/01*** | (2006.01) |
| ***A41D 13/05*** | (2006.01) |
| ***A41D 17/02*** | (2006.01) |
| ***F21V 33/00*** | (2006.01) |
| ***F21V 17/10*** | (2006.01) |
| ***F21S 9/02*** | (2006.01) |
| ***F21V 31/00*** | (2006.01) |
| ***F21V 23/04*** | (2006.01) |
| ***F21S 4/22*** | (2016.01) |
| *F21Y 115/10* | (2016.01) |

(52) U.S. Cl.

CPC ..... *A41D 13/001* (2013.01); *A41D 13/01* (2013.01); *A41D 13/0543* (2013.01); *A41D 17/02* (2013.01); *F21S 4/22* (2016.01); *F21S 9/02* (2013.01); *F21V 17/10* (2013.01); *F21V 23/04* (2013.01); *F21V 31/00* (2013.01); *F21V 33/0008* (2013.01); *F21Y 2115/10* (2016.08)

(58) Field of Classification Search

CPC ... A41D 17/02; A41D 13/001; A41D 13/0543
USPC ..... 2/59, 162, 170
See application file for complete search history.

(56) References Cited

U.S. PATENT DOCUMENTS

| | | | | |
|---|---|---|---|---|
| 4,646,727 | A | 3/1987 | Chambers | |
| 4,716,594 | A | 1/1988 | Shannon | |
| 5,005,215 | A | 4/1991 | McIlquham | |
| 5,119,510 | A | 6/1992 | Shilling | |
| 6,964,493 | B1 * | 11/2005 | Whitlock ..... | A41D 13/01 2/102 |
| 8,602,073 | B2 | 12/2013 | Swain | |

(Continued)

*Primary Examiner* — Katherine M Moran
(74) *Attorney, Agent, or Firm* — The Van Winkle Law Firm; William G. Heedy

(57) ABSTRACT

A reversible mesh garment to prevent mosquito bites and increase safety through greater visibility of the wearer in dark conditions includes a tubular sleeve formed from mesh fabric, the tubular sleeve having a first end and a second end; first and second adjustable elastic bands housed in a woven fabric casing at each end of the tubular sleeve, wherein the first elastic band spans the perimeter circumference of the first end of the tubular sleeve and the second elastic band spans the perimeter circumference of the second end of the tubular sleeve so as to secure the garment to the wearer's legs from groin to ankle; an LED light source; and an additional layer of a strip of mesh fabric two inches wide is sewn as the top outer layer at the side seams thereby forming a mesh channel housing the LED light source.

5 Claims, 9 Drawing Sheets

(56) References Cited

U.S. PATENT DOCUMENTS

| | | | | |
|---|---|---|---|---|
| 2004/0040068 | A1 | 3/2004 | Silver | |
| 2008/0141441 | A1 | 6/2008 | Canter | |
| 2011/0075399 | A1* | 3/2011 | Yuan | A41D 13/01 362/103 |
| 2014/0283560 | A1 | 9/2014 | Patton et al. | |
| 2015/0276203 | A1* | 10/2015 | Mcbee | F21V 33/0008 362/465 |

* cited by examiner

MOSQUITO AND SAFETY GARMENT

RELATIONSHIP TO PRIOR APPLICATION

This patent application is a Continuation-In-Part patent application relating to and claiming the benefit of U.S. Non-Provisional patent application Ser. No. 14/804,848, which relates to and claims the benefit of U.S. Provisional Patent Application Ser. No. 62/027,461 filed Jul. 22, 2014.

FIELD OF THE INVENTION

The present invention relates generally to an apparatus for protection from insects. More specifically, the present invention is a set of mesh-like "sleeves" with adjustable elastic bands at the top and bottom made to slide over the legs to protect from mosquito bites while still wearing your typical summer shorts, and further including an element for increased visibility of the wearer.

BACKGROUND OF THE INVENTION

Mosquitoes can present a variety of problems to anyone exposed to them. These problems range from a slightly red itchy bump on the skin that easily resolves, to transmission of deadly viruses that have claimed many lives. Many individuals have an allergic type of reaction to the bites requiring over-the-counter antihistamines and pain relievers. Some experience mild fever when receiving multiple bites at one time. If the allergic reaction is more severe a person may require antibiotics and/or steroids to treat severe redness, swelling, pain, and cellulitis, which is an infection of the skin itself. Now health problems arising from the Zika virus have added a whole new level of concern with exposure to mosquitoes.

Over 3,000 species of mosquitoes exist in the world. The inherent issue with these insects is the species that are vectors of disease, and with each blood meal, pass diseases from host to host. Malaria, Yellow Fever, and La Crosse Encephalitis are some of the more recognized life-threatening illnesses associated with mosquitoes. West Nile Virus is also known to result in West Nile Fever or in more severe cases will result in neuroinvasive illnesses such as encephalitis and meningitis. My niece contracted LaCrosse encephalitis during the summer of 2014 from a mosquito bite. After a week in intensive care, she improved and survived. However, it took months for the majority of sequelae to subside which included seizures while hospitalized, ongoing headaches and behavioral changes. Many families have dealt with this issue particularly in geographical areas within the US and beyond where mosquitoes are abundant.

Not only do we want to keep our children safe from deadly illnesses, we want to protect them from accidents like being struck by a car while playing outside. According to the Association for Psychological Science, getting hit by a car is the third leading cause of death among children ages 5 to 9, and adolescents up to age 15 make up a disproportionate number of pedestrian casualties across the globe. A child's injuries are more likely to be fatal when hit by a car simply due to being smaller. A few key factors are observed when looking at how and why these accidents occur. Children are more easily distracted and don't always notice cars when they're playing. Their reaction times are slower and speedy drivers in residential areas increase their vulnerability. We can't change a child's developmental pace and force a sudden enhanced reaction time to dangers. We can't control the speeding car at the second before an accident. What we can control is adding safety measures when possible to give children a better chance of being visible to drivers.

A garment that prevents mosquito bites and adds visibility of the wearer should have specific attributes making it usable in every possible aspect. The garment should be able to be used when participating in a variety of activities, particularly for children, such as running, playing, camping, hiking, or bike riding. The garment should be comfortable, breathable, easy to put on and take off, adaptable in use with any apparel, cost-effective, appealing in appearance, and chemical-free.

Currently the options to prevent mosquito bites are:

1. Spraying chemical repellents containing DEET on skin or clothing.
2. Applying citronella oil, still a chemical, directly onto skin or clothing.
3. Staying close to a flame source of citronella.
4. Wearing pants and long sleeves even in hot weather.
5. Wearing complete mesh outfits over existing clothing.
6. Wearing protective clothing with repellent soaked into the textile fiber during manufacturing.

Each of these options has drawbacks making it potentially restricting of activity, uncomfortable, and/or potentially harmful to the skin of an individual. In my search for options that combine mosquito protection and offer added safety for the wearer, I have not found that such a combination exists. While numerous insect repelling garments exist and may be suitable in certain conditions, the prior art referenced differs from the present invention in a number of ways with respect to the type of insects repelled, activity for which it is created, method of wearing, and the chemical and structural components of the textiles.

U.S. Pat. No. 5,005,215 to McIlquham discloses a tic-repelling chap for each leg extending from ankle to upper thigh which contains a specified area on the textile for applying tick repellent. To secure the garment, ties at the top of the garment must be fastened to the wearer's own belt.

U.S. Pat. App. No. 2014/0283560 submitted by LYMEZE, LLC discloses a single purpose tick-repelling forearm and leg covering made of a woven textile treated during the manufacturing process with tick repellent. The leg covering specifically extends from ankle to below the knee.

U.S. Pat. No. 4,716,594 to Shannon discloses a multilayered garment with separate components of a jacket and pants. The textile utilized for the inner most layer against the skin is described as a thick, coarse mesh. The garment is intended for use by hunters and outdoorsman.

U.S. Pat. No. 5,119,510 to Schilling discloses a full-body outfit made of single layer no-see-um mesh comprising jacket, pants, and leggings. The leggings specifically are constructed as a tubular shape from the top of the leg to the ankle with elastic bands at the top and bottom of the tube and a stirrup at the lower elastic band to secure the garment under the foot or shoe of the wearer. The present invention differs in that it requires the upper elastic band function in a manner that the wearer can adjust the band to their specific need with regard to size, comfort, and stability of the garment at groin level and that the elastic be encased in a woven fabric allowing the wearer the versatility of wearing the garment directly against the skin under shorts or on the outside of shorts. The present invention requires a decorative ribbon be affixed to the outside layer of mesh at the side seam and a light-reflective safety ribbon be affixed to the inside layer of mesh at the side seam. The present invention requires the garment be reversible so the wearer is able to utilize the light-reflective safety ribbon at the side seam during evening outdoor activity thereby increasing visibility of and safety of the wearer.

SUMMARY OF THE INVENTION

In accordance with one form of the present invention, there is provided a reversible mesh garment to prevent mosquito bites and increase safety through greater visibility of the wearer in dark conditions including a tubular sleeve formed from mesh fabric, the tubular sleeve having a first end and a second end; first and second adjustable elastic bands housed in a woven fabric casing at each end of the tubular sleeve, wherein the first elastic band spans the perimeter circumference of the first end of the tubular sleeve and the second elastic band spans the perimeter circumference of the second end of the tubular sleeve so as to secure the garment to the wearer's legs from groin to ankle; an LED light source; and an additional layer of a strip of mesh fabric two inches wide is sewn as the top outer layer at the side seams thereby forming a mesh channel housing the LED light source. The LED light source may be a strand of LED lights, the strand of LED lights being selectively removable from the garment. The elastic bands at opposite ends may be adjustable by means of a fastener. The fastener used to secure the adjustable elastic bands at each end may be a cord lock, toggle, button, buckle, snap, hook and loop, clip, or knotted cord. A secondary fastener made from a cord, lock, toggle, button, buckle, snap, hook and loop, clip, or knotted cord may be affixed to the upper fabric casing to secure the garment to the clothing of the wearer.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS OF THE INVENTION

Referring to the several views of the drawings, the mosquito and safety garment of the present invention is shown. All illustrations of the drawings are for the purpose of describing selected versions of the present invention and are not intended to limit the scope of the present invention.

The present invention consists of no-seeum mesh tubular sleeves with adjustable elastic bands at the top and bottom made to slide over the legs to protect from mosquito bites while still wearing your typical summer shorts. This provides a chemical free, non-toxic barrier for the skin. The garment can be worn in conjunction with regular clothing and is still reversible and adjustable. The user can put them on and take them off without having to remove their regular clothes making it an easier and desirable option to prevent mosquito bites in a variety of outdoor activities. The present invention is constructed with children in mind primarily for this product though it could be made available for teens and adults as well.

Figure 1:
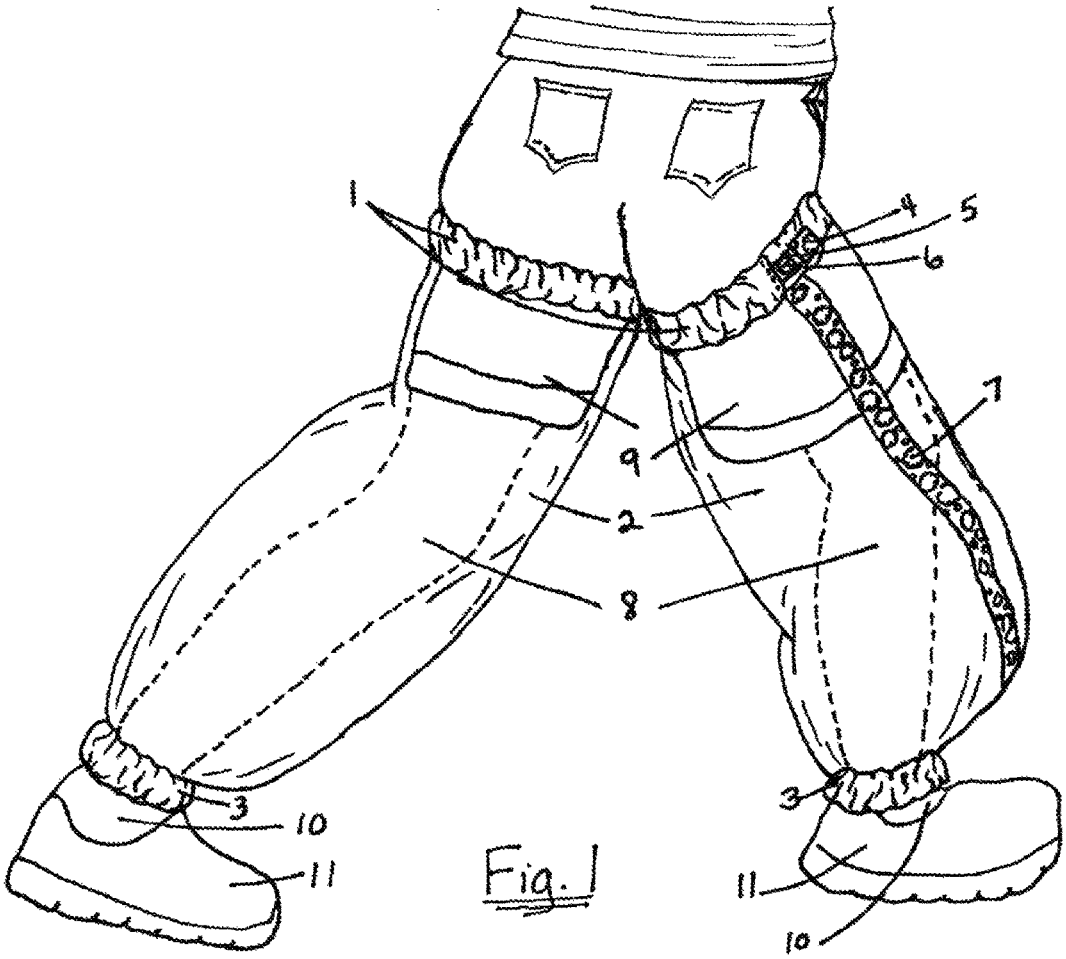
FIG. 1 illustrates the garment shown on each leg groin to ankle, worn over shorts.

Referring to FIG. 1, the garment is shown on each leg 8 from groin to ankle over a pair of shorts 9. The mesh fabric 2 is configured into a cylindrical shape with longest raw edges secured neatly between the outer and inner ribbons 7. The adjustable button-hole elastic 5 encased in the upper woven fabric casing 1 is holding the garment securely at groin level directly against the fabric of the shorts 9 of the wearer. To achieve the appropriate fit of the adjustable button-hole elastic 5 the pull tab 4, secured to the elastic with an iron-on adhesive, is pulled far enough to expose button holes, which exist throughout the entire length of said elastic. The wearer or parent of the wearer selects the desired length and slips the button 6 through the appropriate button hole sufficient to secure the garment in place. The lower woven fabric casing 3 which houses the non-rolling ankle elastic fits snugly against the sock 10 or ankle of the wearer preventing entrance of insects and preventing the mesh fabric 2 from slipping down over the shoe 11. The gathered effect on the mesh fabric 2 causes said mesh fabric to distend away from the leg 8.

Figure 2:
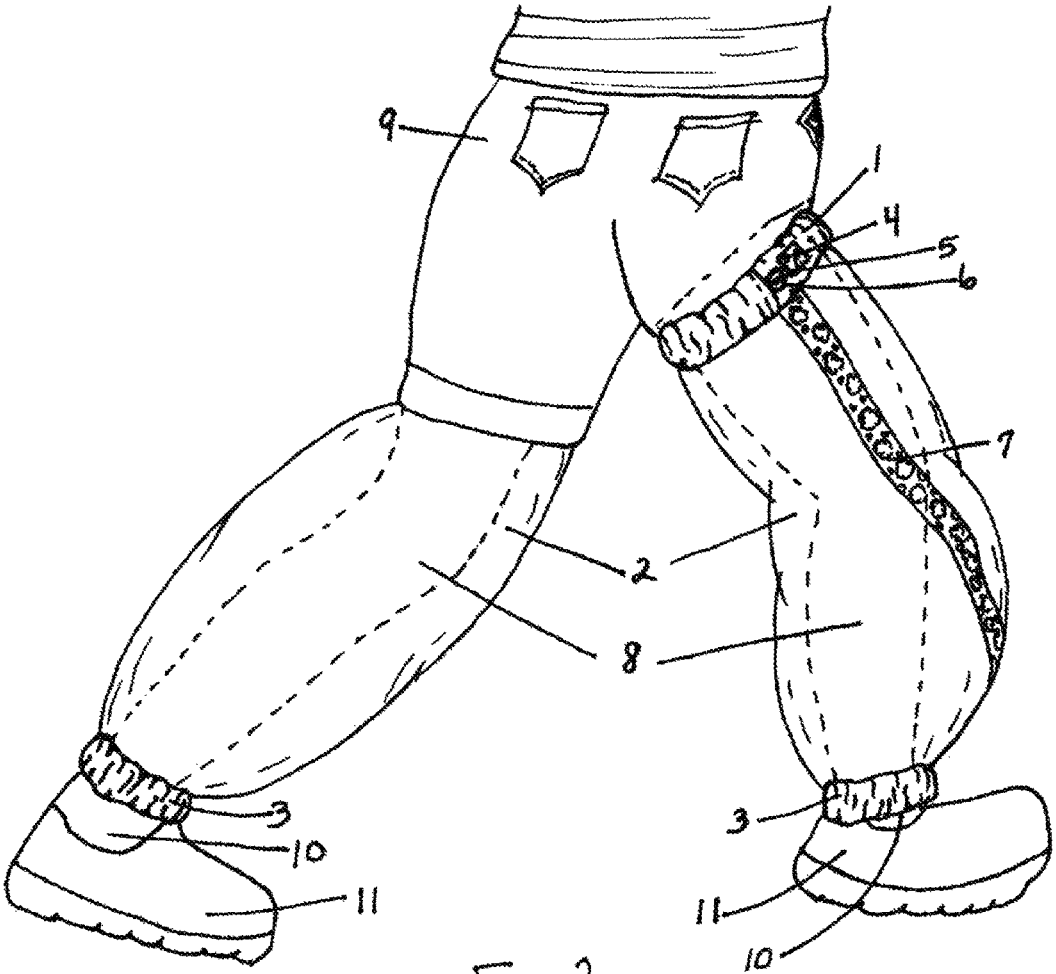
FIG. 2 illustrates the garment shown on each leg groin to ankle, worn under shorts.

Referring to FIG. 2, the garment is shown on each leg 8 worn under a pair of shorts 9 groin to ankle. The leg 8 on the left shows how the garment appears when worn under a pair of shorts 9 with the mesh fabric 2 still able to balloon away from the leg 8. The leg 8 on the right shows how the upper woven fabric casing 1 appears under the shorts 9 against the skin of the leg 8 itself at the groin. Wearing the upper woven casing 1 against the skin lessens the diameter and subsequently lessens the tension on the button-hole elastic 5. This elastic is adjusted more snuggly if needed by pulling the pull tab 4 to a length sufficient to achieve the desired fit. The lower woven fabric casing 3 maintains position at the sock 10 just above the shoe 11. Ribbons 7 are still visible between the bottom edge of the shorts 9 and the lower woven fabric casing 3 when worn in this fashion.

Figure 3:
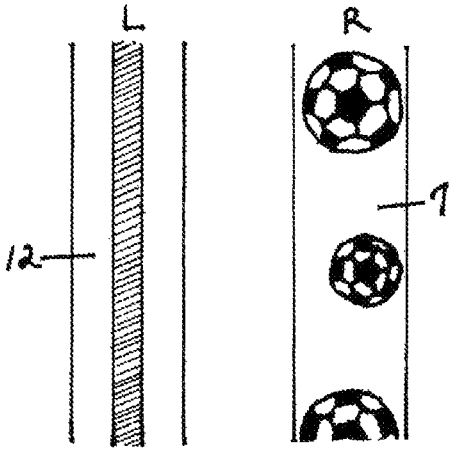
FIG. 3 illustrates ribbons used on garment side-seam.

Referring to FIG. 3, light-reflective safety ribbon 12 on the left and a decorative ribbon 7 are used to secure the longest raw edges of mesh fabric 2. True ribbon width is ⅞".

Figure 4:
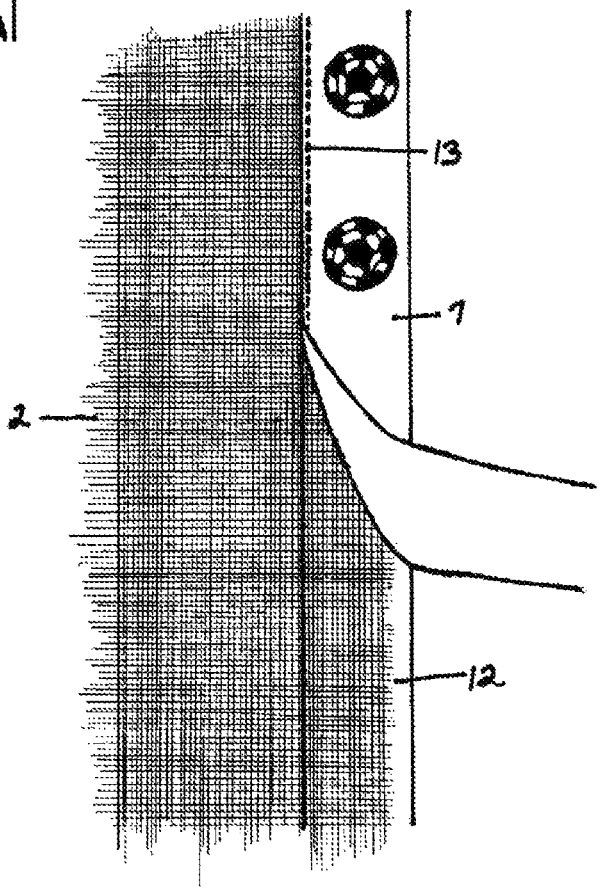
FIG. 4 illustrates sewing one raw edge of mesh between the two ribbons.

Referring to FIG. 4, the first longest raw edge of mesh fabric 2 is shown laid in between and being sewn in between the backsides of the decorative ribbon 7 and the light-reflective safety ribbon 12. The first sewn seem of thread 13 occurs on the left side of the ribbons 7, 12.

Figure 5:
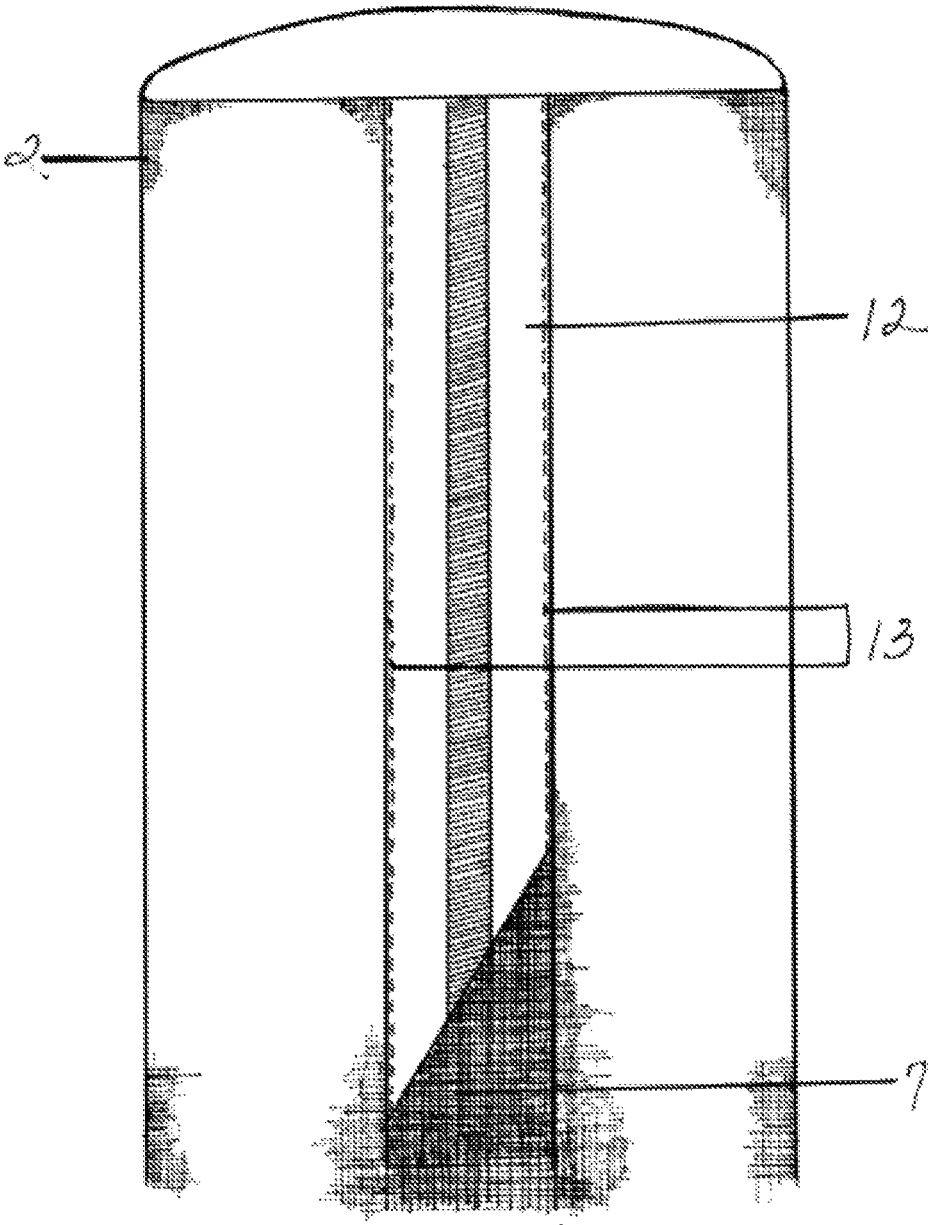
FIG. 5 illustrates sewing opposing raw edge of mesh between the two ribbons completing the tube.

Referring to FIG. 5, the completed tube is shown prior to attachment of casings. The second raw edge of mesh fabric 2 has been wrapped around to form a cylindrical shape. The second sewn seam of thread 13 is added down the right side of the ribbons 7, 12. With both raw edges of mesh fabric 2 having been sewn between the back sides of the light-reflective safety ribbon 12 and the decorative ribbon 7 the tube is created.

Figure 6:
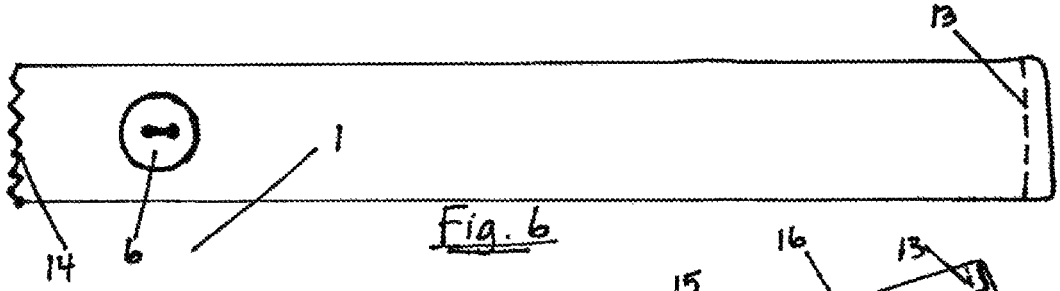
FIG. 6 is a side elevational view of the folded upper woven fabric casing.

Referring to FIG. 6, the upper woven fabric casing 1 is shown as it appears before being sewn on to the tube in FIG. 5. It is folded and pressed. The front side is shown. The raw woven fabric edge 14 on the left is cut with pinking shears which are special scissors that cut a zig-zag shape to prevent fibers from unraveling. The opposing folded/pressed raw edge of woven fabric at the end of the upper casing 15 is secured with a sewn seam of thread 13. The ⅝" button 6 is sewn on securing the elastic band (not shown in this figure) already placed between the fold.

Figure 7:
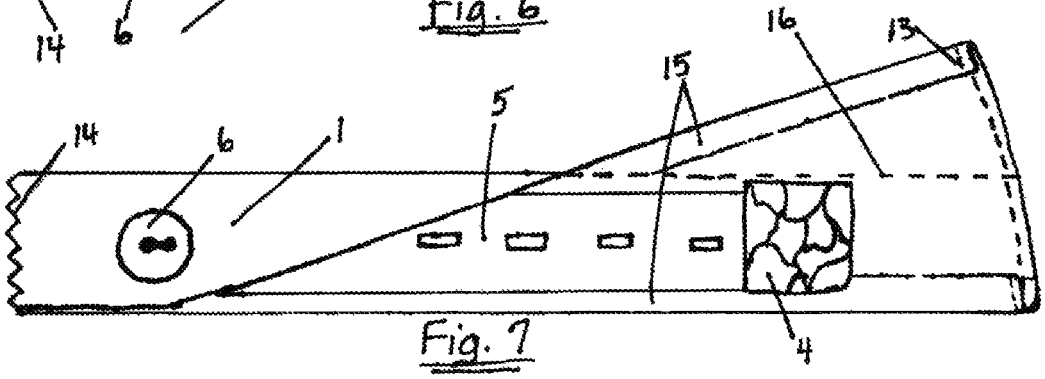
FIG. 7 is a side elevational view of the inside of the upper woven fabric casing completely assembled.

Referring to FIG. 7, the upper woven fabric casing 1 is shown folded open exposing the button-hole elastic 5, secured with a ⅝" button 6, the pull tab 4 made of decorative ribbon 7, and the lower raw edges of woven fabric 14 folded inward and pressed along the full length of said casing. Also noted in this figure is the folded and pressed woven fabric top edge of the upper casing 16, the raw woven fabric edge 14 on the left cut with pinking shears and the opposing folded/pressed raw edge of woven fabric at the end of the upper casing 15 folded and secured with a sewn seam of thread 13.

Figure 8:
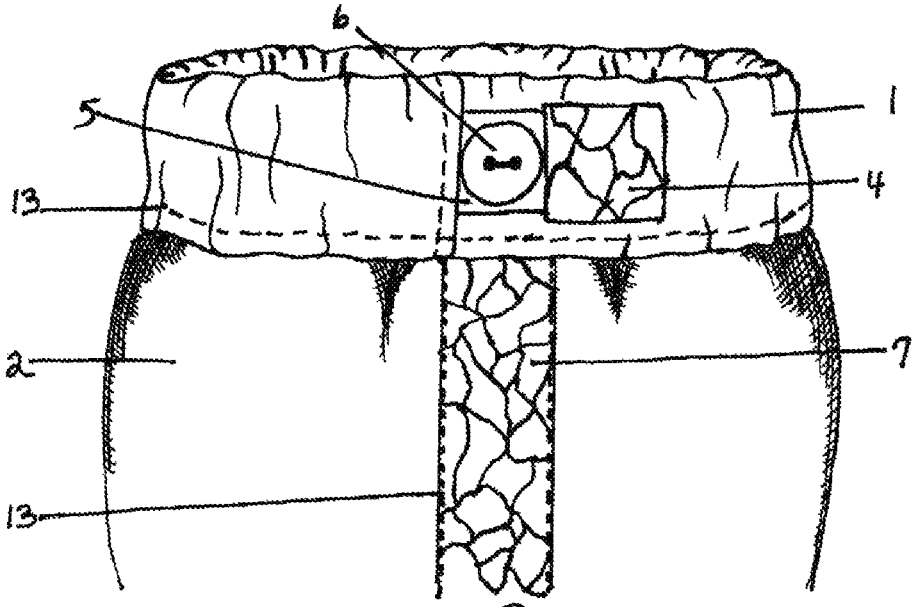
FIG. 8 is a front elevational view of the upper woven casing sewn onto top edge of mesh tube.

Referring to FIG. 8, the upper portion of a small child-sized garment is shown when completely assembled. Components visible are the upper woven fabric casing 1 which now has a gathered appearance where a sewn seam of thread 13 connects it to the top edge of the mesh fabric 2. Contributing to the gathered appearance is the button-hole elastic 5 once pulled through the length of the upper woven fabric casing 1 by the pull tab 4, and secured by the ⅝" button 6. The decorative ribbon 7 is seen with sewn seams of thread 13 down each side completing and securing the cylindrical shape and thereby the function of the mesh fabric 2.

Figure 9:
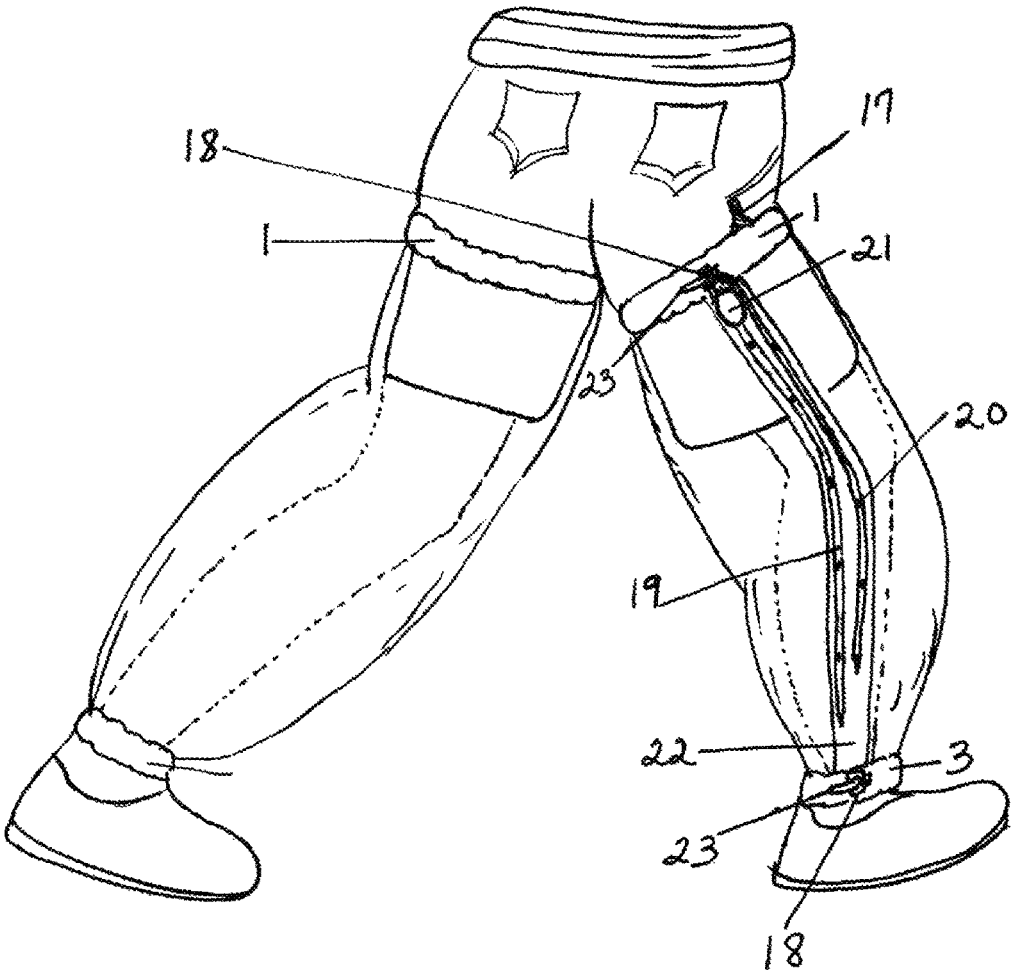
FIG. 9 is a perspective view of first and second garments on respective legs of the wearer each covering groin to ankle worn over the shorts, wherein a strand of LED lights are provided thereon.

Referring to FIG. 9, the garment is shown with additional features specific to the added light source. The upper woven fabric casing 1 is shown with a cord lock 18 which secures elastic 23 at a set tension to secure the fit at groin level of the wearer. An LED strand 19 containing LED lights 20 (collectively, the LED light source) is fed down a mesh channel 22 to house the LED light source down the outer side seam. The power button/battery housing 21 is secured just below the cord lock 18 as a portion of the LED strand 19 is first fed under and back over the cord lock 18, before it is fed down the mesh channel 22. A cord lock 18 secures elastic 23 within the lower woven fabric casing 3 at the lower garment end at the ankle of the wearer.

Figure 10:
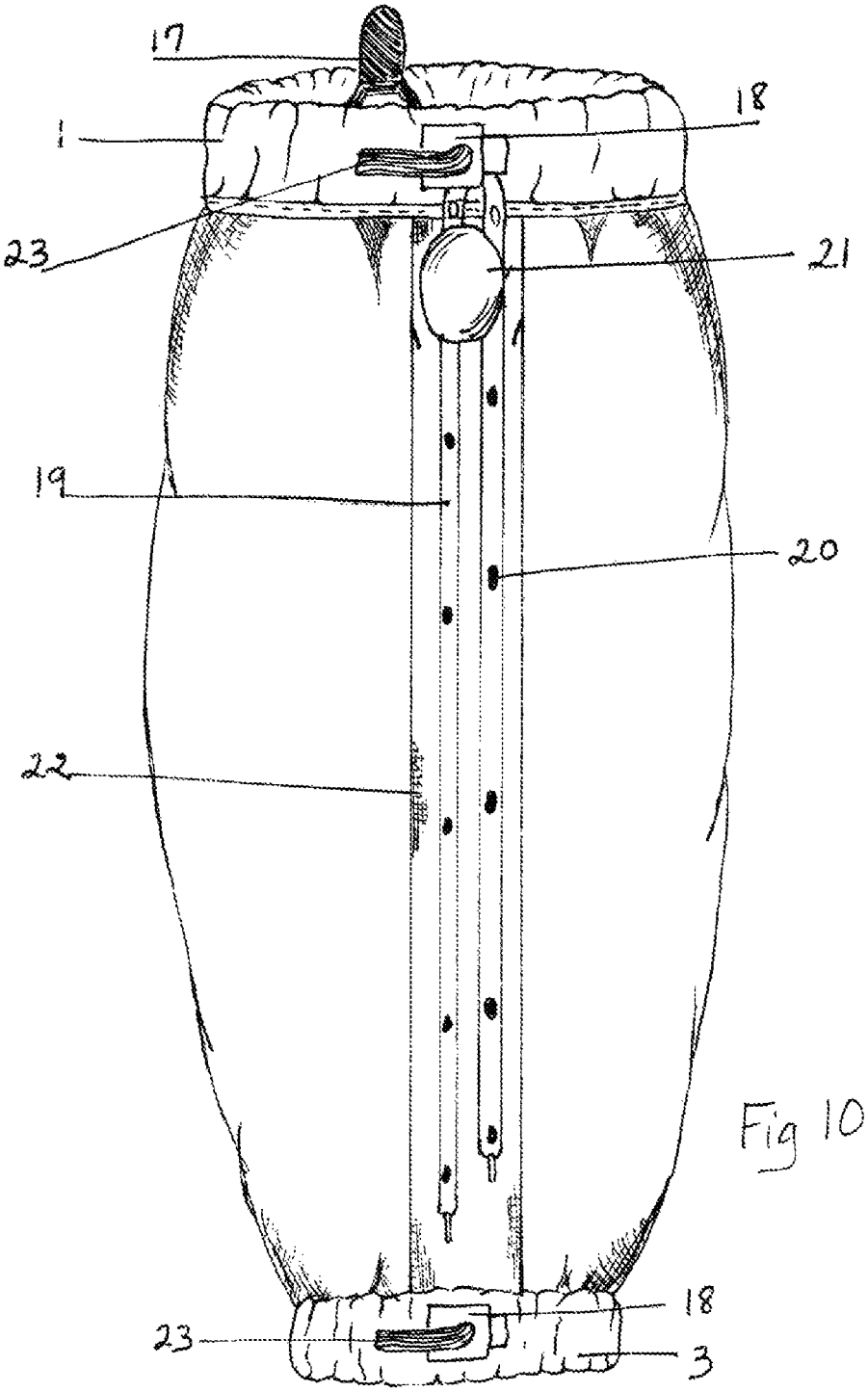
FIG. 10 is a front elevational view of the garment and including adjustable elastic and cord locks and a strand of LED lights housed in a mesh channel down the side seam.

Referring to FIG. 10, LED lights 20 within an LED strand 19 are located within the mesh channel 22 to house the LED light source. A cord lock 18 is present and secured to elastic 23 housed within the upper woven fabric casing 1 and the lower woven fabric casing 3. A plastic clip 17 is secured to the upper woven fabric casing 1 to fasten to the clothing of the wearer. The power button/battery housing 21 is contained at the top of the mesh channel 22 to house the LED light source and is further secured from slipping down said mesh channel 22 with two (2) angled stitches to support power button/battery housing 25.

Figure 11:
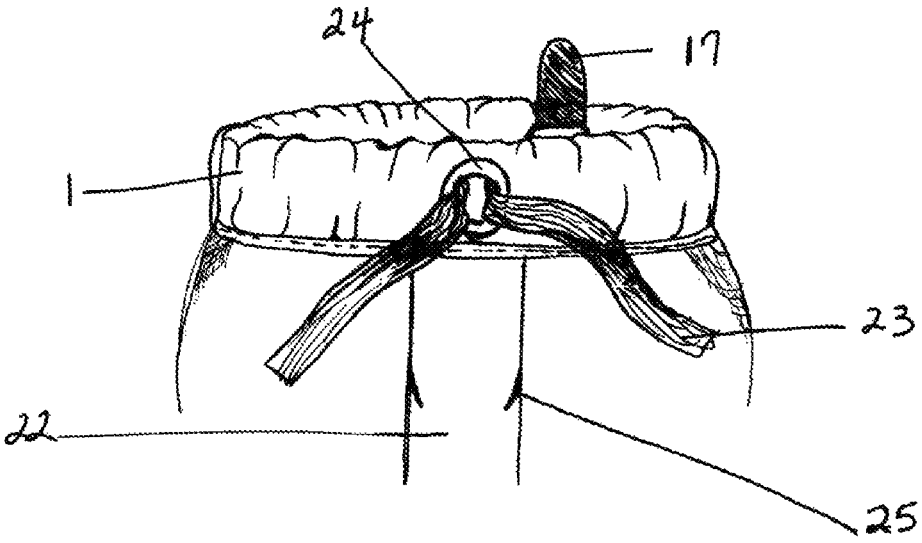
FIG. 11 is a partial front elevational view of the upper casing with the elastic protruding through a grommet so that the elastic would then be attached to a cord lock or simply tied.

Referring to FIG. 11, the upper woven fabric casing 1 with grommet 24 for elastic 23 to come through and be tied or affixed to a fastener. A plastic clip 17 is affixed to the upper woven fabric casing 1 to secure the garment to the clothing of the wearer. The mesh channel 22 to house the LED light source is present with 2 angled stitches to support the power button/battery housing 25.

Figure 12:
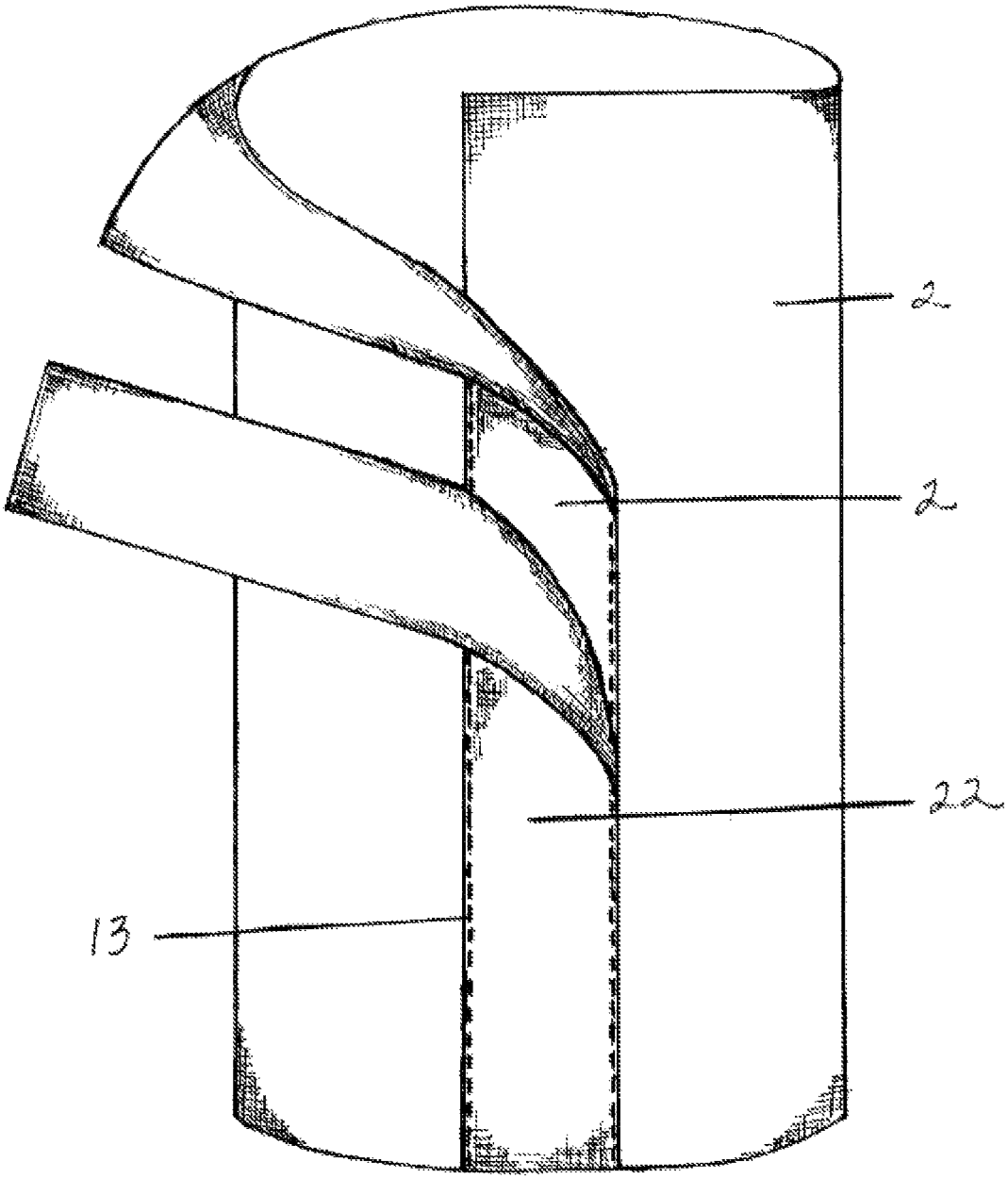
FIG. 12 is a front elevational view of the tubular mesh garment layers as would be sewn together to create the mesh channel to house the light source.

Referring to FIG. 12, layers of mesh fabric 2 form the tubular shape of the garment. View of garment showing how layers are positioned and held together with sewn seams of thread 13 to create the sleeve with the mesh channel 22 to house the LED light source.

Generally, the garment includes no-seeum mesh which has more than enough holes per square inch to keep mosquitoes off the skin and still retain breathability suitable to the wearer. It is sewn with a side seam to create an elongated tubular shaped sleeve which is large enough in diameter to allow the fabric to balloon away from the skin in a significant enough fashion to create an air barrier between the skin and no-seeum mesh. Elastic is simply sewn in to the fabric casing at the top and bottom of the garment. The upper elastic is adjusted by means of a cord lock or other fastener on the outside of the fabric casing which houses the elastic. The top elastic is intended to fit high on the thigh, at the groin area. The bottom elastic is smaller to go around the ankle. This elastic is also adjustable and constructed in the same manner as the upper elastic. The gathering of fabric that occurs at each end of the garment combined with excess girth of mesh fabric around the leg causes the fabric to balloon out around the leg. The lighting source comes from an LED shoelace with the lights dispersed in a strand along the fabric shoelace itself. It has a battery compartment and power button in a plastic housing which is secured at the top of the garment by looping the lace through the upper elastic behind the toggle/cord lock. The battery and power button housing is further held in place with two angled stitches at the base of the housing to prevent it from slipping down the mesh channel. The lace is then fed down the channel created at the side seam when sewn. Lighting features are controlled by a button on the plastic housing which turns the light on and off and offers different flashing modes. This LED light source is easily removed from the garment so that the garment may be washed. This type of lace is not waterproof. The garment can still be constructed with light reflective striping approx. ¼" to ¾" wide on the reverse of the side seam(s). There are products available to utilize in conjunction for the fabric itself to be infused with a nontoxic mosquito repellant. While this invention is made of fabric with no chemical insect repellents, it is understood that this invention could be modified to accommodate the addition of an insect repellent through infusion or attachment. This garment has the ability to be detailed with certain mesh colors or decoration representing any team sport or character. This garment would be useful for the wearer whether at a picnic or summer outdoor sporting event. Parents will feel additional peace of mind when their child is readily visible to oncoming cars and on the hiking trail.

Generally, another embodiment of the garment is identical in the manufacturing of the mesh garment itself with the difference being the LED light source. The LED lighting source is a waterproof LED shoelace which is comprised of solid clear plastic tubing approximately ⅛" in diameter which is secured in a mesh fabric channel created from the side seam as currently constructed. The tubing runs the length of the garment and is attached to the plastic housing compartment for the battery and LED light at groin level. Lighting features are controlled by a button on the plastic housing which turns the light on and off and offers different flashing modes. It is secured to the garment by looping the plastic tubing behind the upper elastic at the toggle/cord lock. This LED light source is easily removed from the garment so that it may be washed. The plastic tubing is waterproof, while the housing for the battery and LED light are not. General sizing would be available or made to order.

Although the invention has been explained in relation to its preferred embodiments, it is to be understood that many other possible modifications, specifically the type of light source provided, and variations can be made without departing from the spirit and scope of the invention.

What is claimed is:

1. A reversible mesh garment to prevent mosquito bites and increase safety through greater visibility of a wearer in dark conditions comprising:

a tubular sleeve formed from mesh fabric, the tubular sleeve having a first end and a second end;

first and second adjustable elastic bands housed in a woven fabric casing at each end of the tubular sleeve, wherein the first elastic band spans a first perimeter circumference of the first end of the tubular sleeve and the second elastic band spans a second perimeter circumference of the second end of the tubular sleeve so as to secure the garment to the wearer's legs from groin to ankle;

an LED light source; and an additional layer of a strip of mesh fabric two inches wide is sewn on the tubular sleeve forming a mesh channel between the mesh fabric and the tubular sleeve for housing the LED light source.

2. The reversible mesh garment of claim 1 wherein the LED light source comprises a strand of LED lights, the strand of LED lights being selectively removable from the garment.

3. The reversible mesh garment of claim 1 wherein the first elastic band and the second elastic band are each selectively adjustable using a fastener.

4. The reversible mesh garment of claim 3 wherein the fastener comprises a cord lock, toggle, button, buckle, snap, hook and loop, clip, or knotted cord.

5. The reversible mesh garment of claim 1 wherein a clip is selectively affixed to the woven fabric casing to secure the tubular sleeve to an article of clothing of the wearer.

* * * * *